US012031402B2

(12) United States Patent
Haneferd et al.

(10) Patent No.: US 12,031,402 B2
(45) Date of Patent: Jul. 9, 2024

(54) IMPROVING ACCESS INTO SUBSEA STRUCTURES

(71) Applicant: Subsea 7 Norway AS, Stavanger (NO)

(72) Inventors: Rasmus Haneferd, Hundvag (NO); Karl Erik Suphellen, Algard (NO); Arne Rasmussen, Klepp Stasjon (NO); Knut Sigmund Lende, Voll (NO)

(73) Assignee: SUBSEA 7 NORWAY AS, Stavanger (NO)

( * ) Notice: Subject to any disclaimer, the term of this patent is extended or adjusted under 35 U.S.C. 154(b) by 877 days.

(21) Appl. No.: 17/050,820

(22) PCT Filed: Apr. 26, 2019

(86) PCT No.: PCT/EP2019/060754
§ 371 (c)(1),
(2) Date: Oct. 26, 2020

(87) PCT Pub. No.: WO2019/207114
PCT Pub. Date: Oct. 31, 2019

(65) Prior Publication Data

US 2021/0047875 A1 Feb. 18, 2021

(30) Foreign Application Priority Data

Apr. 26, 2018 (GB) ..... 1806823

(51) Int. Cl.
*E21B 33/037* (2006.01)
*B63G 8/00* (2006.01)
*E02D 29/09* (2006.01)

(52) U.S. Cl.
CPC ..... *E21B 33/037* (2013.01); *B63G 8/001* (2013.01); *E02D 29/06* (2013.01); *B63G 2008/002* (2013.01)

(58) Field of Classification Search
CPC ..... E21B 33/037
See application file for complete search history.

(56) References Cited

U.S. PATENT DOCUMENTS 4,273,472 A 6/1981 Piazza et al.
5,176,471 A 1/1993 Frafjord et al.
(Continued)

FOREIGN PATENT DOCUMENTS

CA 2248054 * 3/2000
GB 1 602 001 11/1981
(Continued)

OTHER PUBLICATIONS

Klove, Brynjulv et al., "Subsea production satisfies Tordis field development," Oil & Gas Journal, vol. 90, Issue 5, Feb. 3, 1992.
(Continued)

*Primary Examiner* — Sunil Singh
(74) *Attorney, Agent, or Firm* — MATTINGLY & MALUR, PC

(57) ABSTRACT

A protective subsea housing for protecting an equipment space enclosed by the housing has an access opening in a wall of the housing for providing access to the equipment space by an unmanned underwater vehicle (UUV). The housing has a closure that is movable by translation, or by rotation relative to an axis transverse to or extending through the wall, to open and close the access opening, and an operating member, such as a rotary coupling, that is positioned outside the equipment space and is engageable and movable by the UUV to move the closure.

25 Claims, 6 Drawing Sheets

(56) References Cited

U.S. PATENT DOCUMENTS

| | | | | |
|---|---|---|---|---|
| 6,615,923 | B1 * | 9/2003 | Lay, Jr. | E21B 33/037 166/368 |
| 2005/0166458 | A1 * | 8/2005 | McKenzie | B65D 90/10 49/394 |
| 2005/0198902 | A1 * | 9/2005 | Meyer | B65D 90/587 52/192 |
| 2009/0145905 | A1 * | 6/2009 | Kim | B60P 3/226 220/361 |

FOREIGN PATENT DOCUMENTS

| | | |
|---|---|---|
| GB | 2 410 758 | 8/2005 |
| NO | 118529 | 1/1970 |
| NO | 913741 | 3/1993 |
| NO | 336853 | 11/2015 |
| WO | WO 90/04084 | 4/1990 |
| WO | WO 02/075103 | 9/2002 |
| WO | WO 03/044316 | 5/2003 |
| WO | WO 2010/115712 | 10/2010 |
| WO | WO 2012/095485 | 7/2012 |
| WO | WO 2012/138230 | 10/2012 |
| WO | WO 2016/085352 | 6/2016 |
| WO | WO 2017/191106 | 11/2017 |
| WO | WO 2017191106 A1 * | 11/2017 |
| WO | WO 2010115712 A2 * | 10/2020 |

OTHER PUBLICATIONS

Klove, Brynjulv et al., "Subsea production satifies Tordis field development," Oil & Gas Journal, vol. 90, No. 5, pp. 38-44, Feb. 3, 1992.

* cited by examiner

IMPROVING ACCESS INTO SUBSEA STRUCTURES

BACKGROUND OF THE INVENTION

This invention relates to the challenges of providing and improving access into subsea structures as are used, for example, in the subsea oil and gas industry.

It is well known for subsea oil and gas pipelines to connect to, or to incorporate, subsea structures that are dedicated to particular functions required in a subsea installation. For example, some such structures may serve as templates for drilling a subsea well and for housing wellheads and related equipment such as Christmas trees. Other such structures may serve as subsea processing centres for conditioning production fluids that flow from a well.

Subsea structures designed for exploitation of hydrocarbons contain various items of equipment and accessories that enable flow management of fluids, such as connectors, valves, ports and auxiliary control panels. Such structures also contain small-diameter piping, for example two-inch (5.1 cm) lines for injection of chemicals. Some subsea structures also carry replaceable modules, for example a pump module or a control system module.

It is often desirable for a subsea structure to protect the equipment, accessories or modules that it carries. For example, protection may be required against objects that could be dropped from vessels on the surface above. This requires a subsea structure to have a roof, cover or frame that extends over and at least partially encloses the equipment, accessories or modules beneath. Protection is especially required against overtrawling, which is a particular risk when producing hydrocarbons in relatively shallow waters such as the North Sea.

Protection against overtrawling requires a subsea structure to be shaped to avoid snagging fishing nets. Thus, such a structure has a generally smooth outline with rounded edges and inclined faces. Commonly, the structure will have substantially flat side or end faces that are inclined to the vertical so as to intersect the plane of a horizontal top surface at an obtuse angle. Consequently the structure tapers or narrows upwardly from the seabed, which directs trawled fishing nets to ride over the structure rather than becoming snagged and entangled.

WO 03/044316 and GB 2410758 illustrate the conventional solution of adding a protective upper frame to a subsea structure. Tubular members of the frame carry lattice, mesh or solid panels that bridge gaps between those members to cover the more fragile items of equipment and accessories carried by the structure. The frame or the panels may be made of steel or of composites such as glass-fibre reinforced plastics (GRP).

There is also an ongoing need to access equipment, accessories or modules carried by a subsea structure. This may be for various operational purposes such as installation, maintenance, replenishment, replacement and control. Consequently, the requirement for a subsea structure to maintain effective protection of its contents must be balanced against the need to ensure ready access to those contents whenever required.

In this respect, it is often necessary to access the interior of a subsea structure using unmanned underwater vehicles (UUVs) such as remotely-operated vehicles (ROVs). In principle, divers could perform similar tasks if the water is shallow enough but in practice, it is preferable to use a UUV to improve safety, especially in an overhead environment.

UUV intervention requires openings in the protective frame of a subsea structure that are large enough for a UUV to gain the necessary access without becoming snagged. It is also preferable for any closures such as covers or panels over those openings to be movable or removable by a UUV alone without assistance from a surface vessel.

A protective frame on top of a subsea structure often supports closures such as hatches or doors so that the contents of the structure can be accessed when required. Hatches may comprise panels that are articulated to the frame by hinges, for example as shown in WO 2010/115712. A handle allows the hatch to be lifted open by a surface vessel or by an ROV.

GB 1602001 shows how a hatch may be lifted from the surface using cables or wires.

WO 02/075103 discloses another type of hinged cover. However the design and manufacture of this cover is more complex and its articulation may be prone to jamming.

WO 2017/191106 discloses another pivoting articulation arrangement for a hatch.

In WO 2016/085352, an entire cover cap has to be removed from a subsea structure for accessing a wellhead.

The hatches and other movable or removable closures described above are not optimal for subsea use because features such as handles or hooks protruding from them may be snagged by trawls.

Also, wide hatches that must be moved to perform subsea operations involving large accessories or modules may require extra lifting provisions, such as winch wires and/or additional buoyancy, because a UUV alone cannot handle their weight.

SUMMARY OF THE INVENTION

Against this background, the invention provides a protective subsea housing for protecting an equipment space enclosed by the housing. The housing comprises: an access opening in a wall of the housing for providing access to the equipment space by an unmanned underwater vehicle (UUV); a closure that is movable by translation, or by rotation relative to an axis transverse to the wall, to open and close the access opening; and an operating member, positioned outside the equipment space, that is engageable by and movable by the UUV to move the closure.

The closure may be movable substantially parallel to the wall. For example, the wall may be planar, in which case the closure may be movable in a parallel plane.

The closure may be positioned on an inner side of the wall, within the equipment space. Alternatively, the closure may be positioned on an outer side of the wall. In that case, for protection against overtrawling, the closure may be substantially surrounded by a ridge that protrudes from the outer side of the wall.

The closure may be rotatable about a pivot that is fixed to the wall beside the access opening. For example, the closure may comprise a part-circular panel that can be pivoted across or away from the access opening, the panel having a curved edge whose axis of curvature coincides with the pivot.

Conveniently, the operating member may be mounted on the housing and may be spaced from the access opening and the closure.

The operating member is preferably movable relative to the housing to operate a drive mechanism that acts on the closure. For example, the operating member may be a rotatable coupling. The operating member may have at least one female or male formation arranged for engagement with a torque tool of a UUV.

The drive mechanism suitably comprises a drive shaft to which the operating member is connected. The drive shaft may comprise at least one gear that engages the closure to move the closure as the drive shaft turns. The gear may be a sprocket that engages a series of slots in the closure, or a worm that engages a series of teeth on the closure.

The drive shaft may intersect an edge of the closure. For example, where the closure is at least partially circular, the drive shaft may intersect a curved edge of the closure tangentially.

If the drive shaft is positioned on an outer side of the wall, it is preferably substantially concealed within a tubular channel for protection against overtrawling. Such a channel may taper away from the wall.

The drive mechanism may comprises at least one nut fixed to the closure and at least one threaded rod engaged with the nut. When the rod is turned about its longitudinal axis, the nut and the closure move along the turning rod.

The operating member may be connected to the drive mechanism by a generator and motor combination. There may be at least one geared connection between the operating member and the drive mechanism.

The closure may comprise two or more articulated sections. Articulation between successive sections may be about an axis transverse to a direction of opening or closing movement.

The operating member may be a handle that is mounted on, and movable with, the closure.

The access opening may be surrounded by a frame to which the closure is mounted. The frame may be movable relative to the housing, for example by pivoting, to open a larger opening that provides alternative access to the equipment space.

The invention provides a sliding hatch system for subsea protection structures that enables the hatch to be opened by an ROV without extra assistance. The opening mechanism may comprise rotating parts and may be actuated either directly by the ROV, or indirectly. Preferably, direct actuation is achieved by coupling a torque tool of the ROV to a shaft of the mechanism.

The invention removes the need to suspend wires from the surface to lift covers or hatches. This is particularly useful for remote fields that operate with the support of a local UUV but without continuous support from a surface vessel.

Embodiments of the invention provide a hatch for a subsea protection frame, wherein the hatch can slide along a wall of the protection frame between an open configuration and a closed configuration.

The hatch may, for example, slide inside the frame. The hatch may slide in translation and/or in rotation.

The hatch may comprise at least one panel. Two or more panels may be articulated in a direction transverse to the motion of the hatch.

Sliding movement of the hatch may be effected by a drive mechanism. The drive mechanism may comprise at least one shaft that is rotated by coupling directly or indirectly to a tool of an ROV.

The shaft may extend perpendicularly to the direction of translation. The shaft may, for example, wind cables, wires or ropes that connect to at least one panel in the direction of translation. In another approach, the shaft may rotate a gear that couples or meshes with slots arranged successively in the direction of translation.

In another arrangement, at least one shaft of the drive mechanism may be disposed tangentially to a direction of rotation of a shutter that is rotated by turning the shaft. For example, the hatch may comprise teeth at least partially on its circumference that are coupled to a gear in mechanical relation with the shaft.

The torque tool of an ROV may actuate a generator that electrically powers a motor to rotate the shaft of the drive mechanism.

The parts of a frame carrying elements of a hatch mechanism and a hatch may be mounted on a structure that can be opened as a bigger hatch, by hinging or lifting.

In order that the invention may be more readily understood, reference will now be made, by way of example, to the accompanying drawings in which:

DETAILED DESCRIPTION OF THE INVENTION

Figure 1:
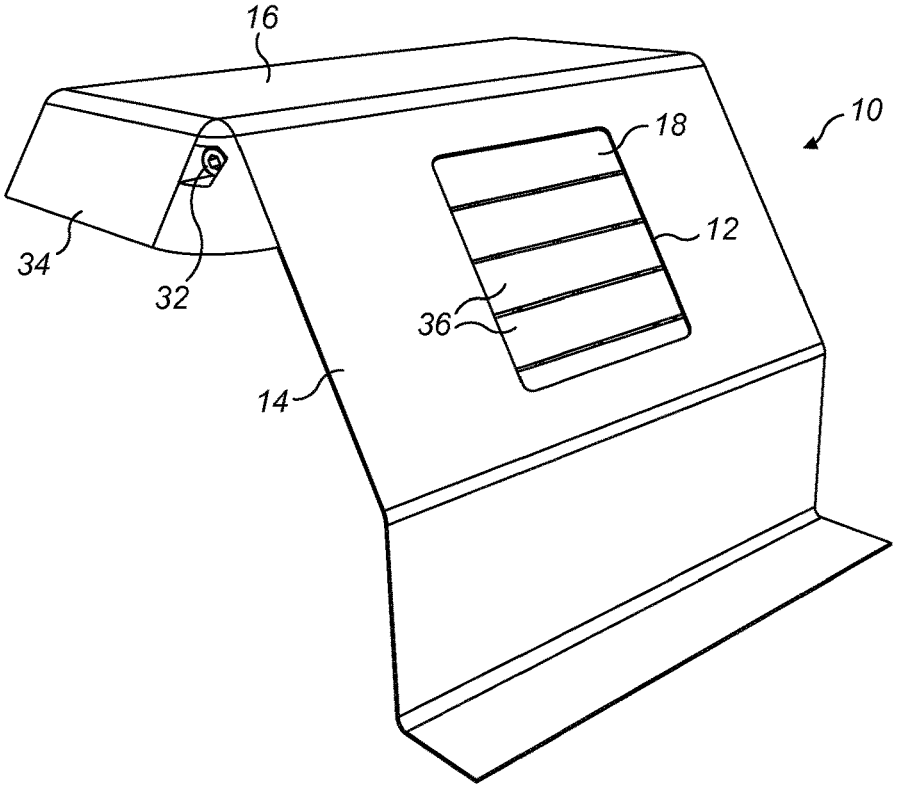
FIG. 1 is an external perspective view of a first embodiment of the invention.

Where possible, like numerals are used in the drawings and in the following description for like features.

FIGS. 1 to 7 and 10*a* to 11*b* of the drawings show part of a protective housing 10 of a subsea structure that is designed for protection against overtrawling. The structure and the housing are designed to be placed in a fixed subsea location, typically resting on the seabed.

The complete housing 10 defines a substantially continuous enclosure for equipment, accessories and modules supported by the structure. Such items have been omitted from the drawings for clarity.

Figure 2:
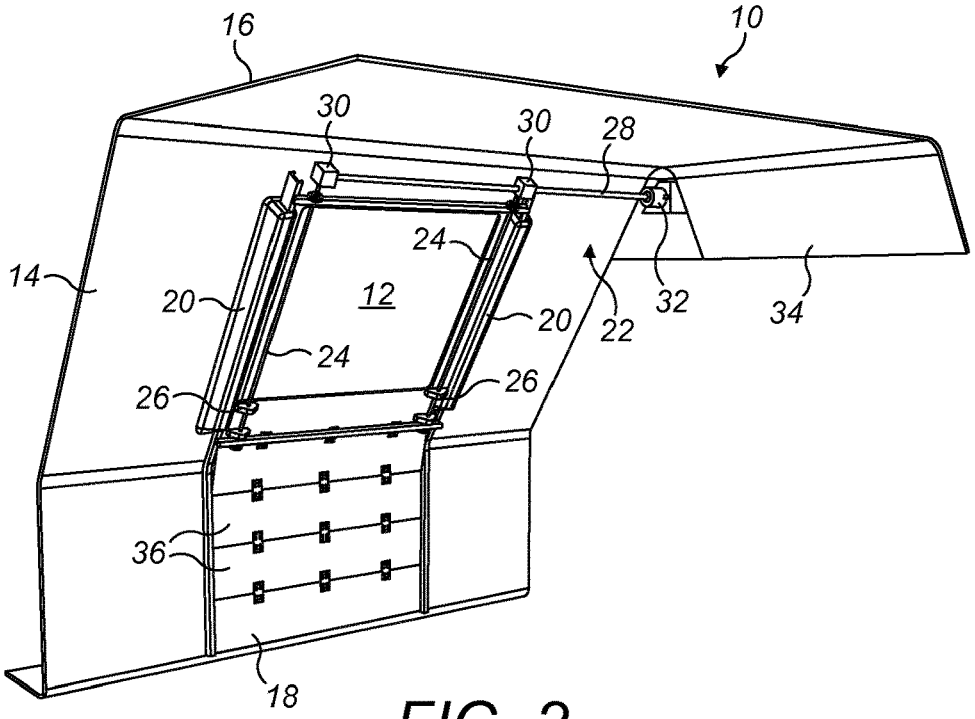
FIG. 2 is an internal perspective view of the first embodiment shown in FIG. 1.

Referring now specifically to FIGS. 1 and 2, these drawings illustrate a first embodiment of the invention. In this example, an access opening 12 is provided in a flat side or end wall 14 of the housing 10 that is inclined to the vertical so as to intersect a horizontal top wall 16 at an obtuse angle. One or more access openings 12 may instead, or additionally, be provided in the top wall 16 of the housing 10 as shown in FIGS. 3 to 7 and 10*a* to 11*b*.

A shutter 18, shown closed in FIG. 1 and open in FIG. 2, serves as a screen, barrier or closure that is retractable and extensible across the access opening 12 to open and close the access opening 12. The shutter 18 runs along parallel rails 20, one each side of the access opening 12 as shown in FIG. 2, which guide the movement of the shutter 18 relative to the access opening 12.

In this example, the shutter 18 translates relative to the access opening 12. In doing so, the shutter 18 moves substantially parallel to the side or end wall 14 of the housing 10 that surrounds the access opening 12. Thus, in this example, the shutter 18 moves in a plane that is similarly inclined to the vertical.

In the example shown in FIGS. 1 and 2, the shutter 18 moves up and down to open and close the access opening 12, specifically moving up to close the access opening 12 and down to open the access opening 12. However, this arrangement could be reversed or the shutter 18 could instead move laterally from side to side.

Movement and positioning of the shutter 18 is driven and determined by a drive mechanism 22. As shown in FIG. 2, the drive mechanism 22 comprises threaded rods 24, one each side of the access opening 12, that suspend the shutter 18 between them on nuts 26 fixed to the inner side of the shutter 18. The threaded rods 24 extend substantially parallel to the side or end wall 14 of the housing 10 that surrounds the access opening 12.

The threaded rods 24 are driven, in turn, by a common drive shaft 28 that is positioned above, and spans the width of, the access opening 12. For this purpose, each threaded rod 24 is connected to the drive shaft 28 by a respective gearbox 30 that may, for example, contain bevel gears to turn the drive through 90°. Consequently, the threaded rods 24 turn around their respective longitudinal axes when the drive shaft 28 is turned about its longitudinal axis.

As the threaded rods 24 turn relative to the shutter 18, the nuts 26 fixed to the shutter 18 move up or down along the threaded rods 24 with synchronised movement. Thus, rotation of the drive shaft 28 in the appropriate angular direction slides the shutter 18 up into the closed position shown in FIG. 1 or down into the open position shown in FIG. 2.

Figure 8:
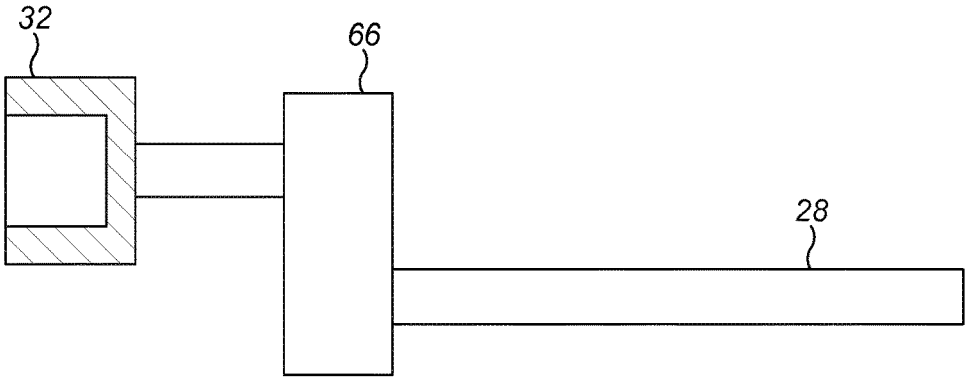
FIG. 8 is a schematic side view of a drive mechanism comprising a gearbox.
Figure 9:
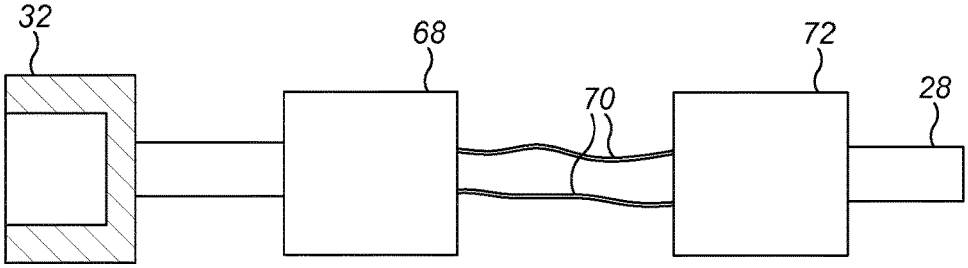
FIG. 9 is a schematic side view of a drive mechanism comprising a generator and motor combination.
Figure 10B:
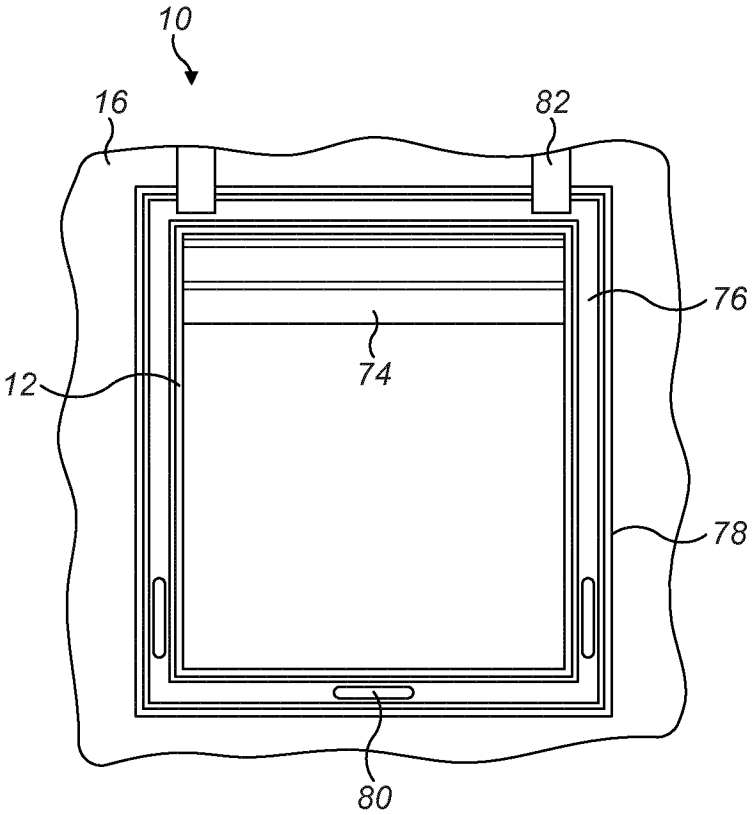
FIGS. 10*a* and 10*b* are top plan views of a fourth embodiment of the invention, showing a hatch closed and partially open within a surrounding frame.
Figure 10A:
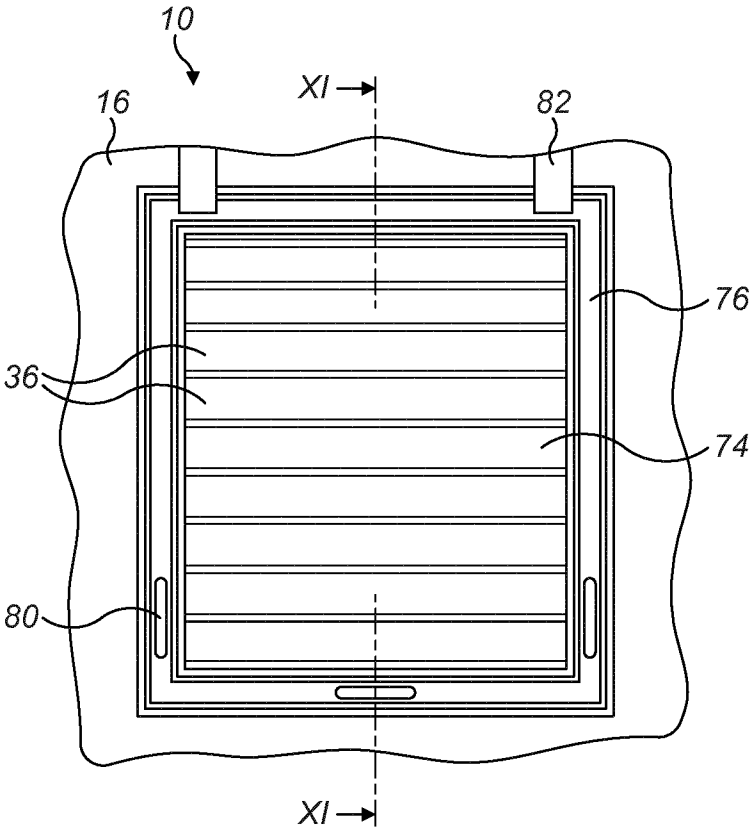
Figure 11A:
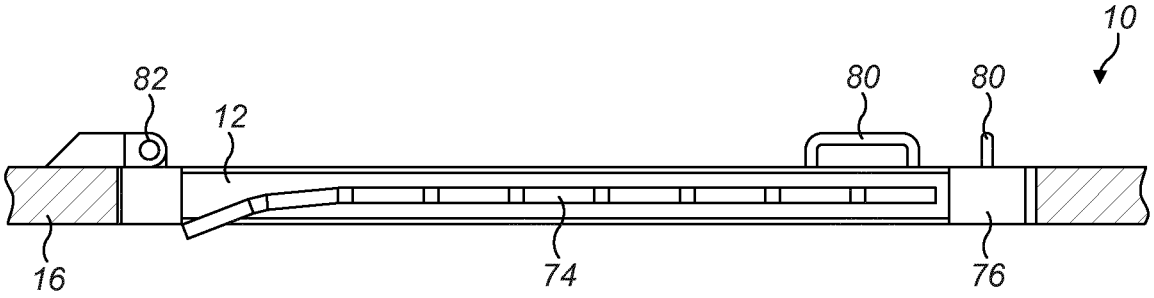
FIGS. 11*a* and 11*b* are sectional side views of the frame in closed and open positions while the hatch remains closed within the frame, the longitudinal section of FIG. 11*a* being taken on line XI-XI of FIG. 10*a*.
Figure 11B:
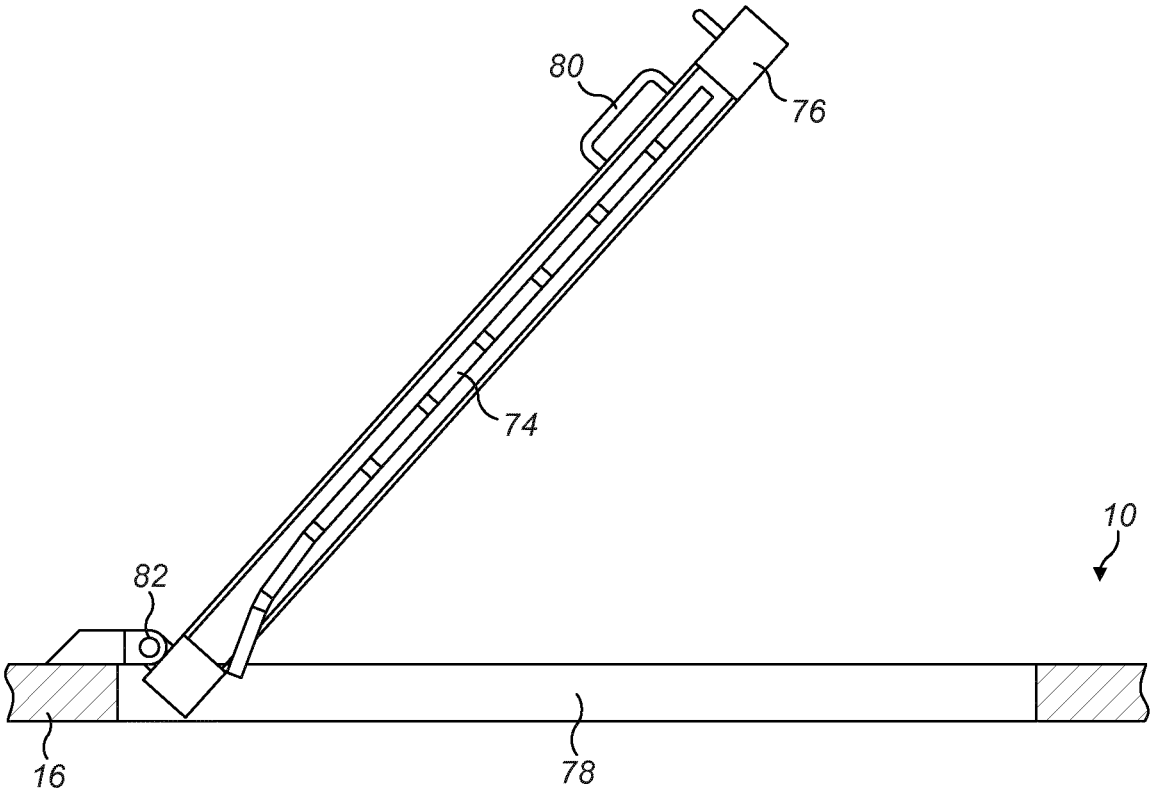

The housing 10 supports an externally-accessible, recessed coupling 32 that serves as an operating member for driving movement of the shutter 18. For this purpose, the coupling 32 is shaped to engage a torque tool held by, or integrated with, an ROV. Typically the coupling 32 has a recess or socket that is arranged to receive the rotary head of a torque tool, as can be seen in FIGS. 8 and 9. In principle, it would be possible for the coupling to have other female or male engagement formations.

As can be appreciated from FIG. 2, the drive shaft 28 extends laterally beyond the access opening 12 to the coupling 32, which may, for example, be on a side wall 34 of the housing 10 spaced from the access opening 12. The coupling 32 is rigidly attached to the drive shaft 28 so that turning the coupling 32 turns the drive shaft 28 and therefore opens or closes the shutter 18.

Thus, the coupling 32 may be regarded as part of the drive mechanism 22 or as acting on the drive mechanism 22. It will be appreciated that the coupling 32 need not be attached directly to the drive shaft 28; for example, an intermediate shaft, a gear system and/or an electrical link could link the coupling 32 to the drive shaft 28. Two such options will be described later with reference to FIGS. 8 and 9.

An ROV hovering beside the housing 10 can couple a torque tool with the coupling 32 and can then activate the torque tool to turn the coupling 32 and thereby to turn the drive shaft 28 to open or close the shutter 18. In this way, the ROV can open the shutter 18 to gain access to the interior of the housing 10 through the access opening 12 to perform tasks on equipment, accessories or modules within the structure. When the tasks are complete, the ROV can leave the housing 10 through the access opening 12 and then can couple its torque tool with the coupling 32 to close the shutter 18.

Preferably, as shown, the shutter 18 comprises a series of articulated sections or slats 36 so that the shutter 18 can bend about the successive axes of articulation. For example, when retracted to open the access opening 12 as shown in FIG. 2, the shutter 18 can bend to follow the contours of the housing 10 below or adjacent to the access opening 12.

FIGS. 3 to 7 and 10*a* to 11*b* show further embodiments of the invention in the context of an access opening 12 in the top wall 16 of the housing 10. However, it should be noted that these embodiments are suitable for use with access openings provided instead, or additionally, in the side or end wall 14 of the housing 10 as shown in FIGS. 1 and 2.

Figure 3:
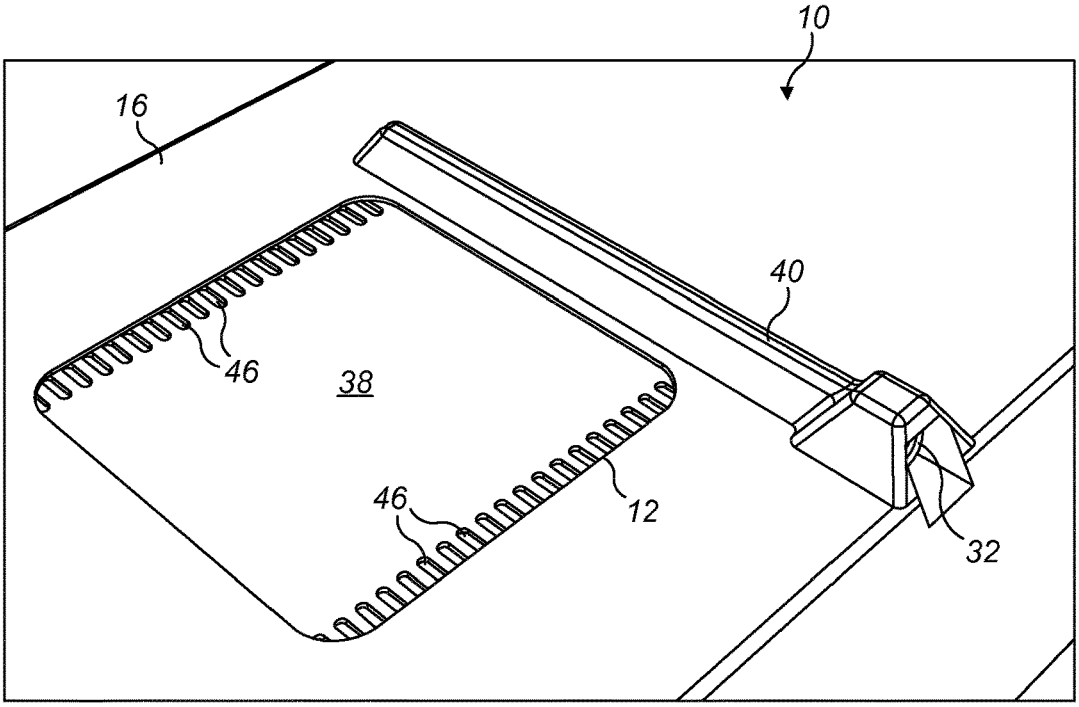
FIG. 3 is an external perspective view of a second embodiment of the invention.
Figure 4:
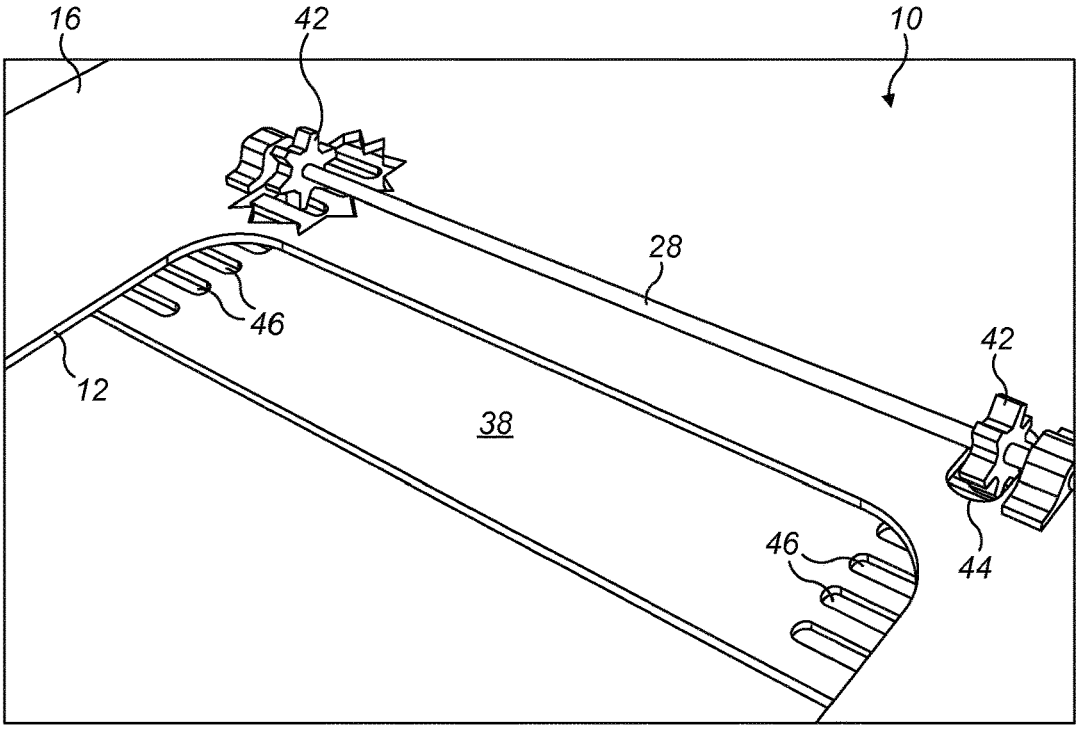
FIG. 4 is an enlarged detail perspective view of the second embodiment shown in FIG. 3.

Turning next, then, to FIGS. 3 and 4, these drawings show a second embodiment of the invention in which a closure 38 is a rigid panel that translates by sliding across the access opening 12, in this case beneath the top wall 16 of the housing 10. The closure 38 is shown closed in FIG. 3 and partially open in FIG. 4.

The closure 38 may run along parallel rails 20 under the top wall 16, one each side of the access opening 12 like the rails 20 shown in FIG. 1.

In this second embodiment, the drive mechanism comprises a drive shaft 28 that extends parallel to the top wall 16 beside the access opening 12. The drive shaft 28 extends orthogonally with respect to the direction of movement of the closure 38.

The drive shaft 28 is concealed within an upwardly-tapering tubular channel 40 on top of the top wall 16. The channel 40 protects the drive shaft 28 against snagging in the event of overtrawling. The channel 40 is open to at least one end. Here, at least one end of the drive shaft 28 terminates in an externally-accessible, recessed coupling 32 for engaging a torque tool of an ROV to turn the drive shaft 28.

As best appreciated in FIG. 4, the drive shaft 28 carries one or more toothed wheels, in this example a pair of sprockets 42 that are spaced longitudinally from each other along the drive shaft 28.

The sprockets 42 align with, and protrude downwardly through, complementary apertures 44 in the top wall 16. Here, the teeth of the sprockets 42 engage with respective rows of slots 46 in the closure 38, aligned with the apertures 44 in the top wall 16.

The rows of slots 46 are parallel to each other and to the direction of movement of the closure 38. In each row, the slots 46 are parallel to each other and extend orthogonally with respect to the direction of movement of the closure 38.

By virtue of the engagement of the sprockets 42 with the rows of slots 46, rotation of the drive shaft 28 about its longitudinal axis, driven by the ROV, is converted into longitudinal movement of the closure 38. Changing the direction of angular movement of the drive shaft 28 changes the direction of movement of the closure 38.

Figure 5:
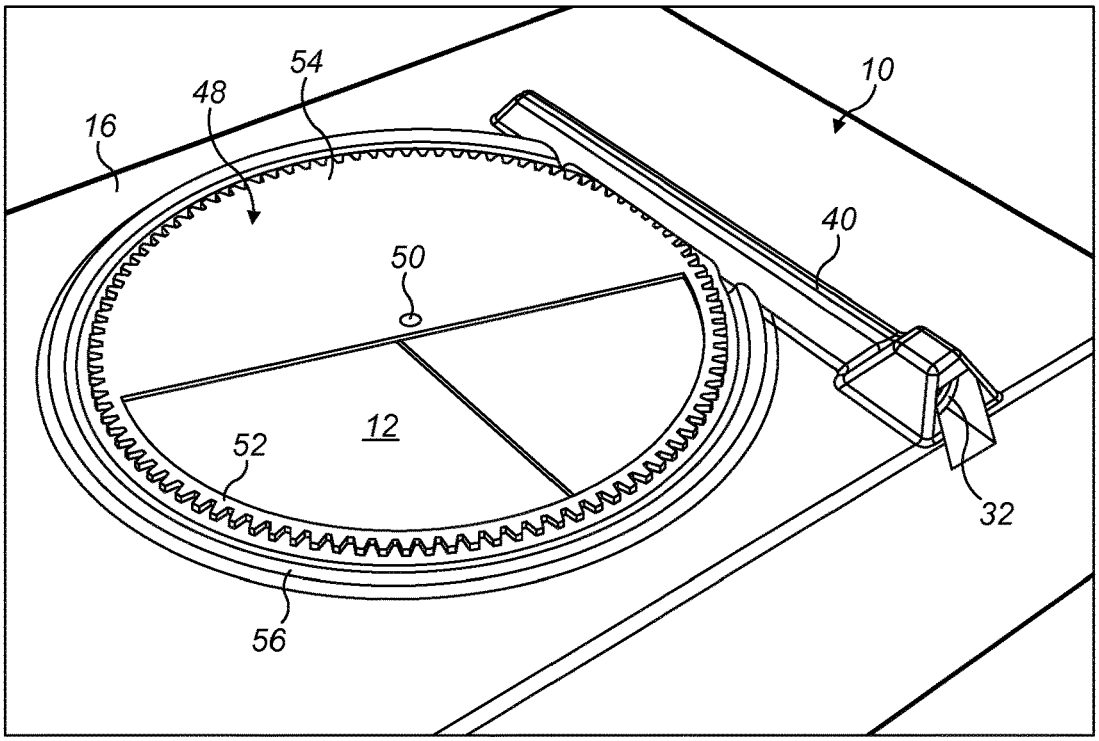
FIG. 5 is an external perspective view of a third embodiment of the invention.
Figure 6:
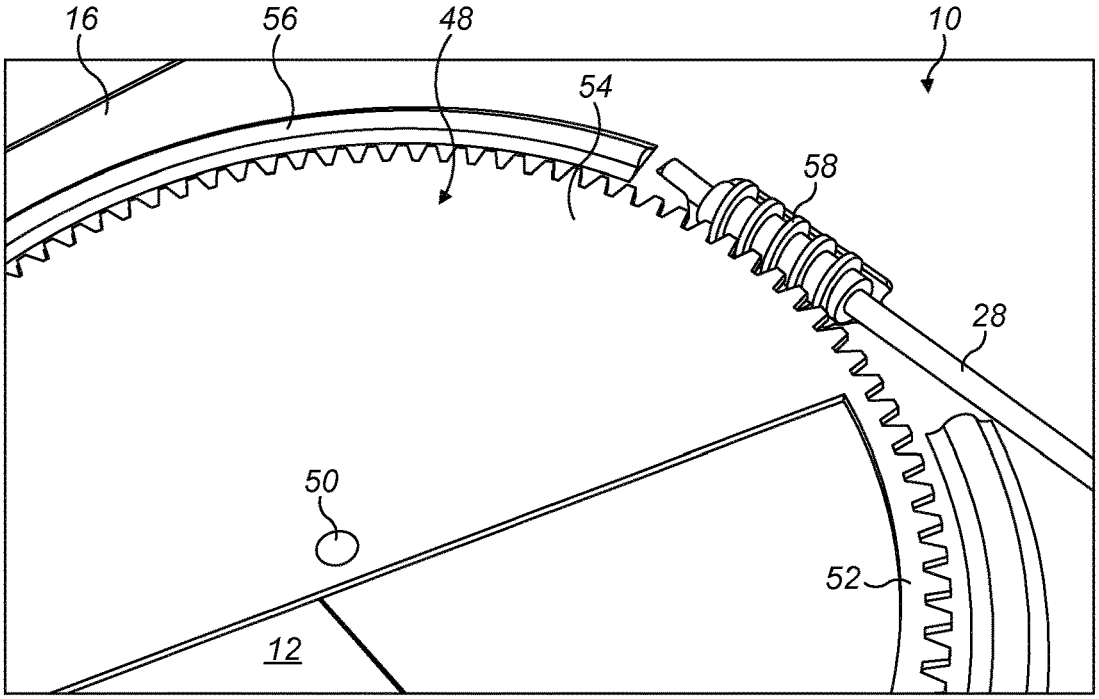
FIG. 6 is an enlarged detail perspective view of the third embodiment shown in FIG. 5.

The third embodiment shown in FIGS. 5 and 6 shows one way in which a closure 48 can move, relative to an access opening 12 of the housing 10, by rotation rather than translation. Here, the closure 48 is circular and planar and turns about its central axis to open and close the access opening 12. The central axis of the closure 48 coincides with a pivot 50 that defines an upright pivot axis. The pivot 50 protrudes upwardly from the top wall 16 of the housing 10 and mounts the closure 48 to the top wall 16. More generally, the pivot axis is transverse to, or extends through, the top wall 16.

In this embodiment, the closure 48 comprises a circular gear ring 52 that has an array of teeth on its radially outer side. The closure 48 further comprises a part-circular infill panel 54 within the gear ring, through which the pivot 50 extends. In this example, the infill panel 54 is defined by a chord that extends across the radially inner side of the gear ring 52, close to the pivot 50, to close just over half of the circular area that is encircled by the gear ring 52.

The infill panel 54 of the closure 48 is shaped and dimensioned to cover a part-circular access opening 12 in the top wall 16 of the housing 10. Like the infill panel 54, the access opening 12 is partially bounded by a chord and has a part-circular boundary that is curved about the pivot axis. The pivot 50 is positioned on the top wall 16 close to the chord of the access opening 12. Thus, the access opening 12 occupies just under half of the circular area that is encircled by the gear ring 52 of the closure 48.

The access opening 12 is encircled by a ridge 56 on the radially outer side of the closure 48. The ridge 56 protects the closure 48 against snagging when overtrawling.

As in the second embodiment shown in FIGS. 3 and 4, the drive mechanism comprises a drive shaft 28 that extends parallel to the top wall 16 of the housing 10 beside the access opening 12. Again, the drive shaft 28 is concealed within an upwardly-tapering tubular channel 40 on top of the top wall 16. Similarly, the channel 40 is open to at least one end to provide access to an externally-accessible coupling 32 of the drive shaft 28 for engagement by a torque tool of an ROV.

In the third embodiment, however, the drive shaft 28 substantially intersects the periphery of the closure 48. In this example, the drive shaft 28 extends substantially tangentially with respect to the periphery of the closure 48. The drive shaft 28 carries a spiral worm 58 that engages the teeth on the circular gear ring 52 of the closure 48.

By virtue of the engagement of the worm 58 with the teeth on the gear ring 52, rotation of the drive shaft 28 about its longitudinal axis, driven by the ROV, is converted into rotational movement of the closure 48 about the pivot 50. Changing the direction of angular movement of the drive shaft 28 changes the direction of angular movement of the closure 48.

Figure 7:
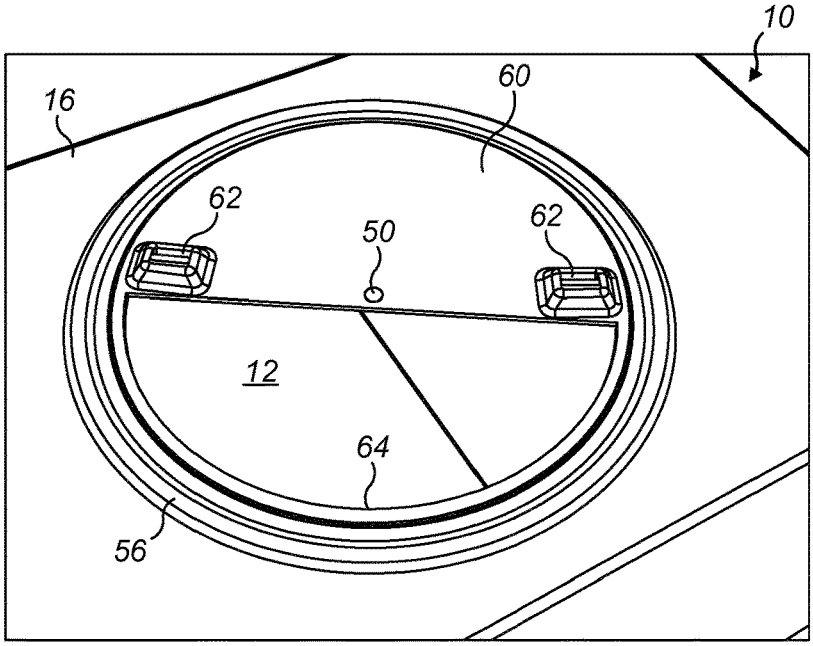
FIG. 7 is an external perspective view of a variant of the third embodiment.

FIG. 7 illustrates a variant of the third embodiment in which most features are unchanged and therefore have like numerals. The main differences here are that the drive mechanism including the drive shaft 28 is omitted, as is the toothed gear ring 52 of the closure 48 shown in FIGS. 5 and 6. Instead, the closure 60 shown in FIG. 7 has one or more handles 62 on the infill panel 54 that serve as operating members. The closure 60 further comprises a plain untoothed ring 64, which could itself be omitted. The closure 60 is turned to open or close the access opening 12 by applying an appropriate force to the or each handle 62 about the pivot 50. A UUV such as an ROV, or a diver, can apply the necessary force.

FIGS. 8 and 9 show, schematically, that the coupling 32 need not be attached directly to the drive shaft 28.

In FIG. 8, for example, the coupling 32 is connected to the drive shaft 28 via a gearbox 66. The gearbox 66 may, for example, comprise meshed pinions of different sizes. The gearbox 66 implements a desired gearing ratio and torque multiplication between the input from a torque tool and the output to the drive shaft 28.

In FIG. 9, the coupling 32 is connected to a generator 68 that generates electrical energy when the coupling 32 is spun by a torque tool. Wires 70 or other conductors convey the electrical energy from the generator 68 to a motor 72 that turns the drive shaft 28. The absence of a rigid link between the coupling 32 and the drive shaft 28 provides greater freedom in positioning the coupling 32 relative to the drive shaft 28.

In a variant of the arrangement of FIG. 9, a gearbox could be interposed between the coupling 32 and the generator 68 or between the motor 72 and the drive shaft 28 to implement a desired gearing ratio if required.

Turning finally to FIGS. 10*a* to 11*b*, a fourth embodiment of the invention mounts a movable closure 74 in a surrounding frame 76, which frame 76 is mounted movably or removably in the top wall 16 of a protective housing 10. A drive mechanism like that shown in the preceding embodiments could be employed to move the closure 74 relative to the frame 76 but has been omitted from FIGS. 10*a* to 11*b* for clarity.

The frame 76 contains a primary access opening 12 that communicates with the interior of the housing 10. The primary access opening 12 can be opened or closed by moving the closure 74 relative to the frame 76, without moving the frame 76 relative to the housing 10. Thus, the closure 74 operates like a wicket gate.

The frame 76 may itself be moved relative to the housing 10, or removed from the housing 10, to open a secondary, but larger, access opening 78 in the housing 10. For this purpose, the frame 76 is provided with handles 80 to be lifted by an ROV or by winch wires suspended from a surface vessel.

The ability to move or to remove the frame 76 may be useful in two scenarios: firstly to provide auxiliary access if the closure 74 ever jams or fails; and secondly to allow access into the housing 10 for the installation or removal of large accessories or modules.

A latch arrangement may be provided to ensure that the frame 76 remains fixed relative to the housing 10 until the latch is deliberately released. For example, an ROV-removable locking pin may act between the frame 76 and the surrounding housing 10.

The closure 74 is exemplified in FIGS. 10*a* to 11*b* as a shutter of articulated slats 36 like that of the first embodiment shown in FIGS. 1 and 2. However, other closure arrangements like those of the other preceding embodiments could be employed.

Whilst the frame 76 is shown in FIGS. 10*a* to 11*b* as being pivotably mounted to the housing 10 by hinges 82, the frame 76 could be moved in other ways relative to the housing 10, such as by translation or rotation.

Many variations are possible within the inventive concept. For example, it would be possible for a UUV other than an ROV, such as an autonomous underwater vehicle (AUV), or indeed for a diver, to couple a torque tool with an external coupling to open or close a shutter or other closure. Also, it is not essential that the same UUV both operates the closure and enters the housing.

The invention claimed is:

1. A protective subsea housing for protecting an equipment space enclosed by the housing, the housing comprising:

an access opening in a wall of the housing for providing access to the equipment space by an unmanned underwater vehicle (UUV);

a closure that is movable by translation, or by rotation relative to an axis transverse to the wall, to open and close the access opening;

an operating member, positioned outside the equipment space, that is engageable by and movable by the UUV to move the closure, wherein the operating member is movable relative to the housing to operate a drive mechanism that acts on the closure; and wherein the operating member is mounted on the housing and is spaced from the access opening and the closure.

2. The housing of claim 1, wherein the closure is movable substantially parallel to the wall.

3. The housing of claim 2, wherein the wall is planar and the closure is movable in a parallel plane.

4. The housing of claim 1, wherein the closure is positioned on an inner side of the wall, within the equipment space.

5. The housing of claim 1, wherein the closure is positioned on an outer side of the wall.

6. The housing of claim 5, wherein the closure is substantially surrounded by a ridge that protrudes from the outer side of the wall.

7. The housing of claim 1, wherein the closure is rotatable about a pivot beside the access opening.

8. The housing of claim 7, wherein the closure comprises a part circular panel that can be pivoted across or away from the access opening, the panel having a curved edge whose axis of curvature coincides with the pivot.

9. The housing of claim 1, wherein the operating member is a rotatable coupling.

10. The housing of claim 9, wherein the rotatable coupling has at least one female or male formation arranged for engagement with a UUV torque tool.

11. The housing of claim 1, wherein the drive mechanism comprises a drive shaft to which the rotatable coupling is connected.

12. The housing of claim 11, wherein the drive shaft comprises at least one gear that engages the closure to move the closure as the drive shaft turns.

13. The housing of claim 12, wherein the gear is a sprocket that engages a series of slots in the closure.

14. The housing of claim 12, wherein the gear is a worm that engages a series of teeth on the closure.

15. The housing of claim 11, wherein the drive shaft intersects an edge of the closure.

16. The housing of claim 15, wherein the closure is at least partially circular and the drive shaft intersects a curved edge of the closure tangentially.

17. The housing of claim 11, wherein the drive shaft is positioned on an outer side of the wall and is substantially concealed within a tubular channel.

18. The housing of claim 17, wherein the channel tapers away from the wall.

19. The housing of claim 1, wherein the drive mechanism comprises at least one nut fixed to the closure and at least one threaded rod engaged with the nut and is arranged to turn the rod so that the nut and the closure move along the turning rod.

20. The housing of claim 1, wherein the rotatable coupling is connected to the drive mechanism by a generator and motor combination.

21. The housing of claim 1, further comprising at least one geared connection between the rotatable coupling and the drive mechanism.

22. The housing of claim 1, wherein the closure comprises two or more articulated sections.

23. The housing of claim 22, wherein articulation between successive sections is about an axis transverse to a direction of opening or closing movement.

24. The housing of claim 1, wherein:

the access opening is surrounded by a frame to which the closure is mounted; and the frame is movable relative to the housing to open a larger opening that provides alternative access to the equipment space.

25. The housing of claim 24, wherein the frame is pivotably mounted to the housing for opening the larger opening.

* * * * *